US007771168B2

(12) United States Patent
Olthof et al.

(10) Patent No.: US 7,771,168 B2
(45) Date of Patent: Aug. 10, 2010

(54) AXIAL FAN

(75) Inventors: Henricus Johannes Bernardus Olthof, Nijverdal (NL); Giorgio Cipelletti, Pompeiana (IT); Hendrik Fedde Van Der Spek, Delden (NL)

(73) Assignee: Howden Netherlands B.V., Hengelo (NL)

( * ) Notice: Subject to any disclaimer, the term of this patent is extended or adjusted under 35 U.S.C. 154(b) by 592 days.

(21) Appl. No.: 11/786,432

(22) Filed: Apr. 11, 2007

(65) Prior Publication Data

US 2008/0031726 A1 Feb. 7, 2008

(30) Foreign Application Priority Data

Apr. 11, 2006 (EP) ..... 06075861

(51) Int. Cl.
*F04D 29/36* (2006.01)

(52) U.S. Cl. ..... 416/153; 416/205; 416/210 R

(58) Field of Classification Search ..... 416/147, 416/207, 214 R, 222, 208, 209, 205, 153
See application file for complete search history.

(56) References Cited

U.S. PATENT DOCUMENTS 1,773,349 A 8/1926 Bothezat
2,207,948 A * 7/1940 Sheridan ..... 416/210 R
3,480,373 A * 11/1969 Talbot ..... 416/210 R
4,053,259 A * 10/1977 Bianchi ..... 416/208
5,462,411 A 10/1995 Bianchi
6,131,863 A 10/2000 Fiacco

FOREIGN PATENT DOCUMENTS

FR 1121516 A 8/1956
GB 1165738 A 10/1969
WO 9409277 A 4/1994

* cited by examiner

*Primary Examiner*—Richard Edgar
(74) *Attorney, Agent, or Firm*—The Webb Law Firm

(57) ABSTRACT

The invention relates to an axial fan comprising a boss and a number of blades evenly distributed and arranged to the boss, wherein the blades have an aerofoil profile, each blade is arranged to the boss with a strip, wherein each blade is hollow and the strip is at least partially inserted into the blade, and that at least one fastener runs from the surface of the blade through a corresponding opening in the strip to the opposite surface of the blade, wherein the corresponding opening in the strip is a slot, such that the pitch of the blade is adjustable, by rotation of the blade relative to the strip along the axial axis of the blade.

17 Claims, 4 Drawing Sheets

AXIAL FAN

The invention relates to an axial fan comprising a boss and a number of blades evenly distributed and arranged to the boss, wherein the blades have an aerofoil profile. Such fans have a diameter of typically 5 meters. To guide the airflow such fans are placed in a ring which has preferably a bell shaped inlet.

Such fans are commonly known and the market is highly competitive. Even a small reduction in costs for the fan can provide an increase in market share.

The commonly known fans have a high number of parts and some of these parts have high manufacturing costs.

In FIG. 1 a fan according to the prior art is shown in exploded view. Such a fan comprises a boss 1 onto which a mounting plate 2 is arranged. The connection of the mounting plate 2 with the boss 1 is made by six bolts 3, washers 4 and bushings 5. Each blade 6 having an aerofoil profile is mounted onto the mounting plate 2. In order to make this connection a cast metal block 7 is bolted to the mounting plate 2 with bolts 8 and washers 9. This cast metal block 7 comprises an elastic insert 10 to dampen vibrations. In this elastic insert 10 a hole is provided through which bolt 11 runs and with which fork 12 is connected. A metal tube 13 is then locked onto the fork 12 with plate 14 threaded ends 15, washers 16 and nuts 17.

The tube 13 protrudes into the hollow blade 6 and is connected thereto by bolts 18, washers 19 and nuts 20. The hollow blade 6 is closed off by end caps 21 and 22.

Finally to avoid an airflow through the center of the fan a cover plate 23 can be arranged at the cast metal blocks 7.

As is clear from the prior art fan according to FIG. 1 a plurality of parts is necessary to assemble a fan. On the other hand ceiling fans are known in the prior art, in which the blades are fixed to the hub by a strip. This provides for a low cost solution, but it is not possible to make any adjustments to the position and orientation of the blades in relation to the hub. Furthermore, the known ceiling fans have flat, sheet-like blades without an aerofoil profile.

It is therefore an object of the invention to provide an axial fan with less parts and consequently with reduced manufacturing costs, while maintaining the necessary adjustment options.

This object is achieved by an axial fan according to the invention, which is characterized in that

- each blade is hollow and the strip is at least partially inserted into the blade, and that
- at least one fastener runs from the surface of the blade through a corresponding opening in the strip to the opposite surface of the blade,
- wherein the corresponding opening in the strip is a slot, such that the pitch of the blade is adjustable.

The strip with which the blades are arranged to the hub provide vibration damping which is achieved by the rubber in the cast metal block 7 of a device according to the prior art. Furthermore the manufacturing costs of a strip are far less than manufacturing a cast metal block 7 and a corresponding fork 12, as is the case in a device according to the prior art. By arranging at least part of the strip into the blade, the need for the additional tube 13 with plate 14 and corresponding mounting parts, as in a device according to the prior art, are prevented.

Furthermore by providing the strip with a slot opening the pitch of the blade is still adjustable. So due to this arrangement an axial fan with less parts and consequently with reduced manufacturing costs is achieved, while the necessary adjustment options, in particular the adjustment of the pitch of the blade, are maintained.

In a preferred embodiment of the fan according to the invention, the strip is substantially L-shaped.

In a further preferred embodiment the boss is substantially cylindrical and the short leg of the L-shaped strip is concave and adapted to the circumferential wall of the boss. Accordingly the L-shaped strip can be directly mounted onto the boss avoiding the need of a special mounting plate.

In another embodiment of the axial fan according to the invention a mounting plate having a flat mounting surface is provided for each blade on the boss and the short leg of the L-shaped strip is mounted on the flat mounting surface. Although an additional mounting plate has to be provided, it avoids the need to make the short leg of the L-shaped strip concave. The necessary mounting surface is a small plate having a concave surface and an opposite flat surface. Depending on the manufacturing costs, either the embodiment with the mounting plate can be chosen or the embodiment with the short leg being concave.

Preferably a filler element is inserted into the hollow blade. This filler element can be a very simple part, for example a cylinder, as the filler element only needs to resist the tightening forces of the fastener running through the blade and the L-shaped strip.

In just another embodiment of the axial fan according to the invention, the filler element is substantially cylindrical and the end of the strip inserted into the hollow blade is concave. Due to the concave shape of the strip, the strip is guided along the cylindrical element and it is ensured that adjustment of the pitch of the blade will occur centered around the cylindrical filler element.

In another embodiment of an axial fan according to the invention, the filler element comprises two semi-cylindrical parts arranged on either side of the end of the strip inserted into the hollow blade. This provides for a further simplified axial fan according to the invention, because the end of the strip inserted into the hollow blade, can stay flat, while centered adjustment of the pitch is still ensured.

In again another embodiment of the axial fan according to the invention, the inner wall of the cavity in which the filler element is inserted is at least partially adapted to the outer surface of the filler element. This further contributes to a centered adjustment of the pitch of the blade without risk to misalignment of the blade in relation to the hub.

Preferably, the filler element is positioned between the slot openings. This reduces the costs as no holes have to be arranged in the filler element. Furthermore the clamping is improved as a result.

The slot openings could also be provided in the blade for adjustment of the pitch. Furthermore, the axial fan may comprise a ring shaped housing coaxially arranged to the boss. This ring shaped housing will guide the air propelled by the blades of the fan.

These and other advantages of the invention will be elucidated in conjunction with the accompanying drawings.

Figure 2:
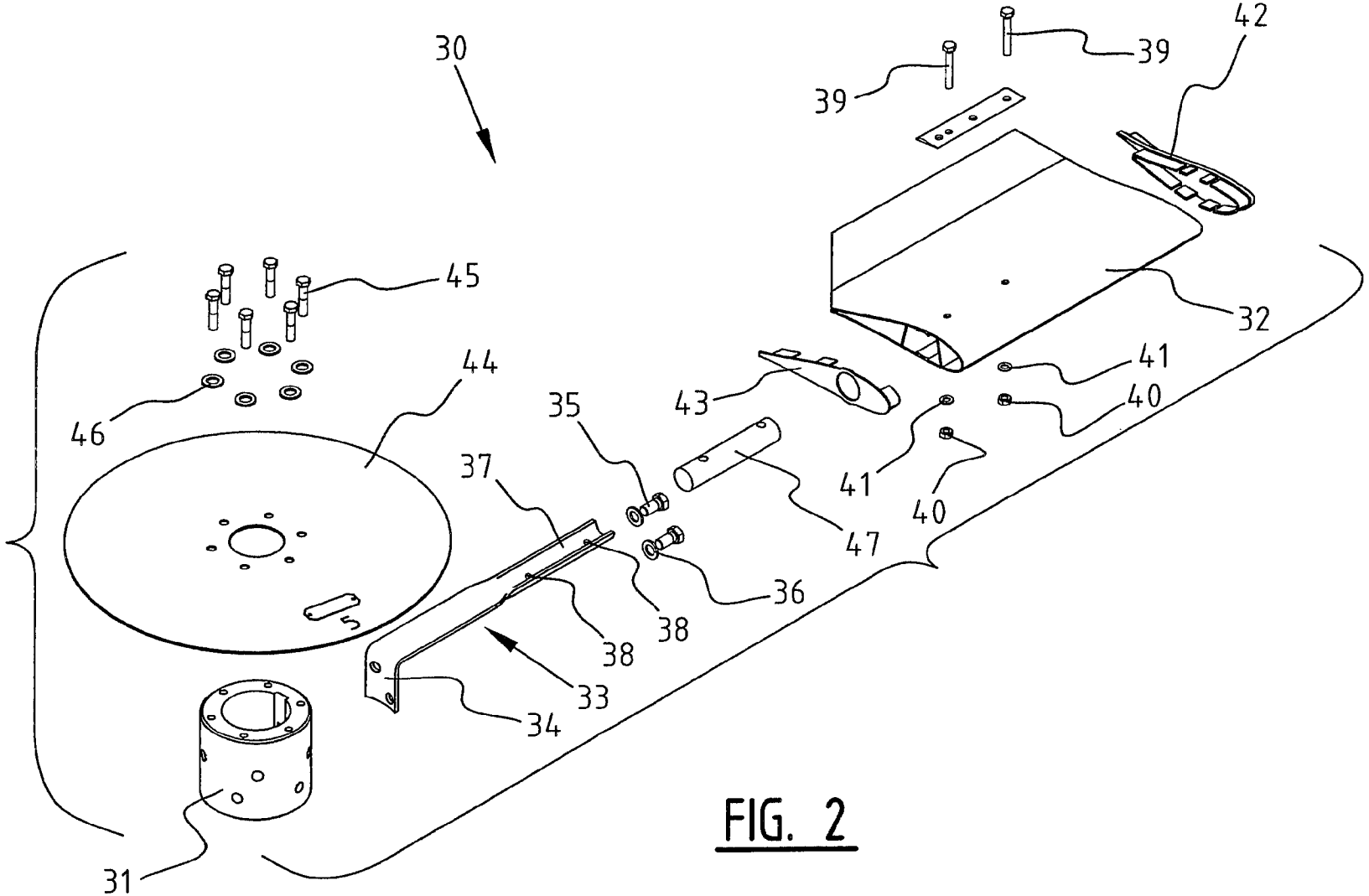
FIG. 2 shows an embodiment of the axial fan according to the invention in exploded view.

In FIG. 2 an axial fan 30 according to the invention is shown. This axial fan 30 has a boss 31 onto which the blades 32 are mounted. The L-shaped strip 33 has a short leg 34, which is concave and directly bolted onto the cylindrical outer surface of the boss 31 with bolts 35 and washers 36. The long leg 37 of the L-shaped strip 33 is partially bent and provided with slot openings 38. This bent part of the long leg 37 is inserted into the hollow blade 32. It is also possible to mount the long leg of the L-shaped strip on the outside of the blade. A filler element 47 is also inserted into the blade 32, after which bolts 39 are inserted attaching the L-shaped strip 33, the filler element 47 and the blade 32 to each other. The bolts 39 are tightened by nuts 40 and washers 41.

The hollow blade 32 is closed off by end caps 42 and 43.

Finally a closing plate 44 can be attached to the boss 31 by bolts 45 and washers 46. This closing plate 44 prevents an air flow through the center of the axial fan.

Figure 1:
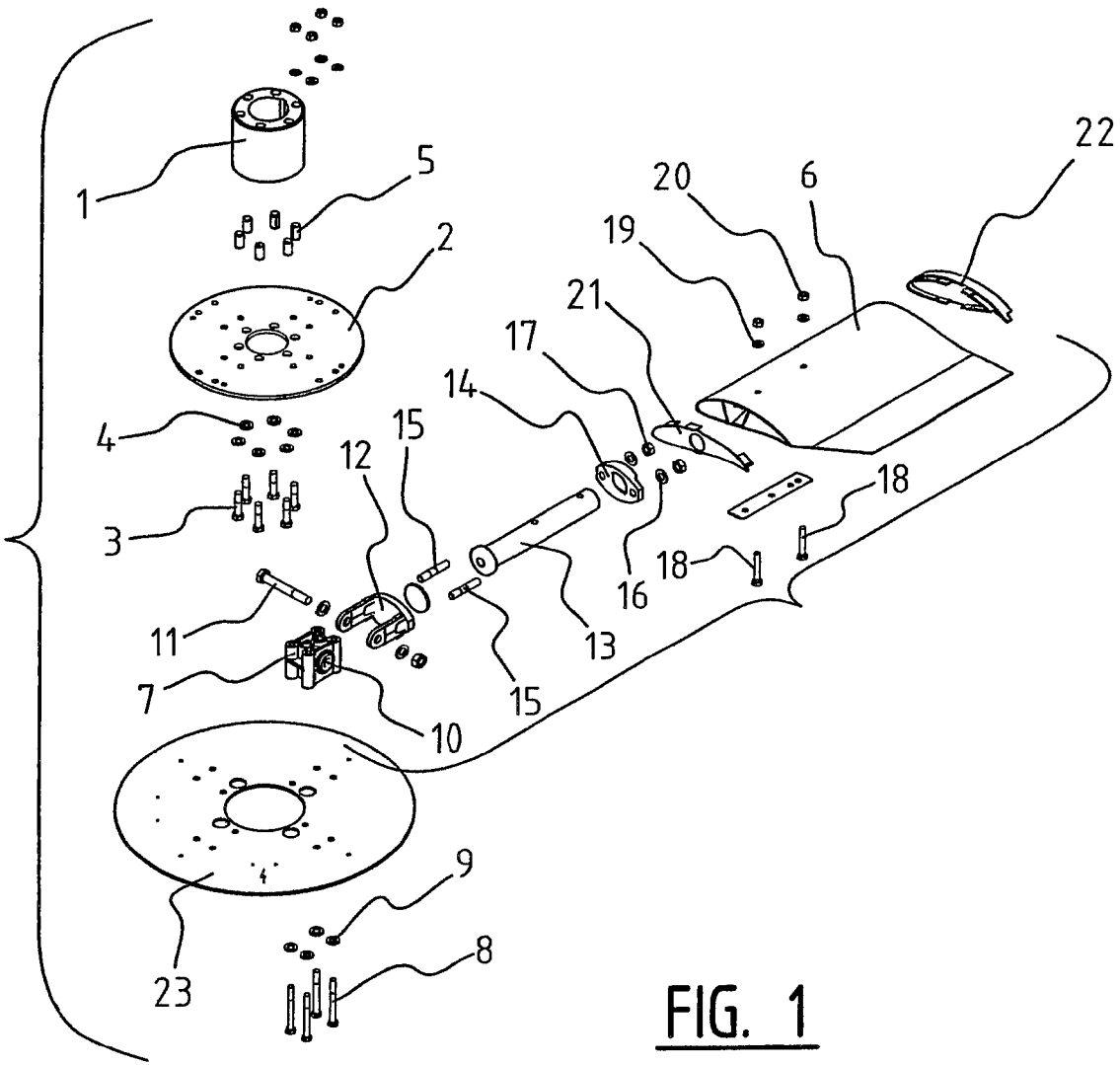
FIG. 1 (PRIOR ART)
FIG. 1 is an exploded view of an axial fan according to the prior art.

When comparing the embodiment of FIG. 2 with the prior art embodiment of FIG. 1 it is directly clear that the invention provides a more simple embodiment, reducing the manufacturing costs. Also the embodiment according to the invention does not use parts, which are difficult to manufacture, such as cast, forged or machined metal blocks.

Figure 3:
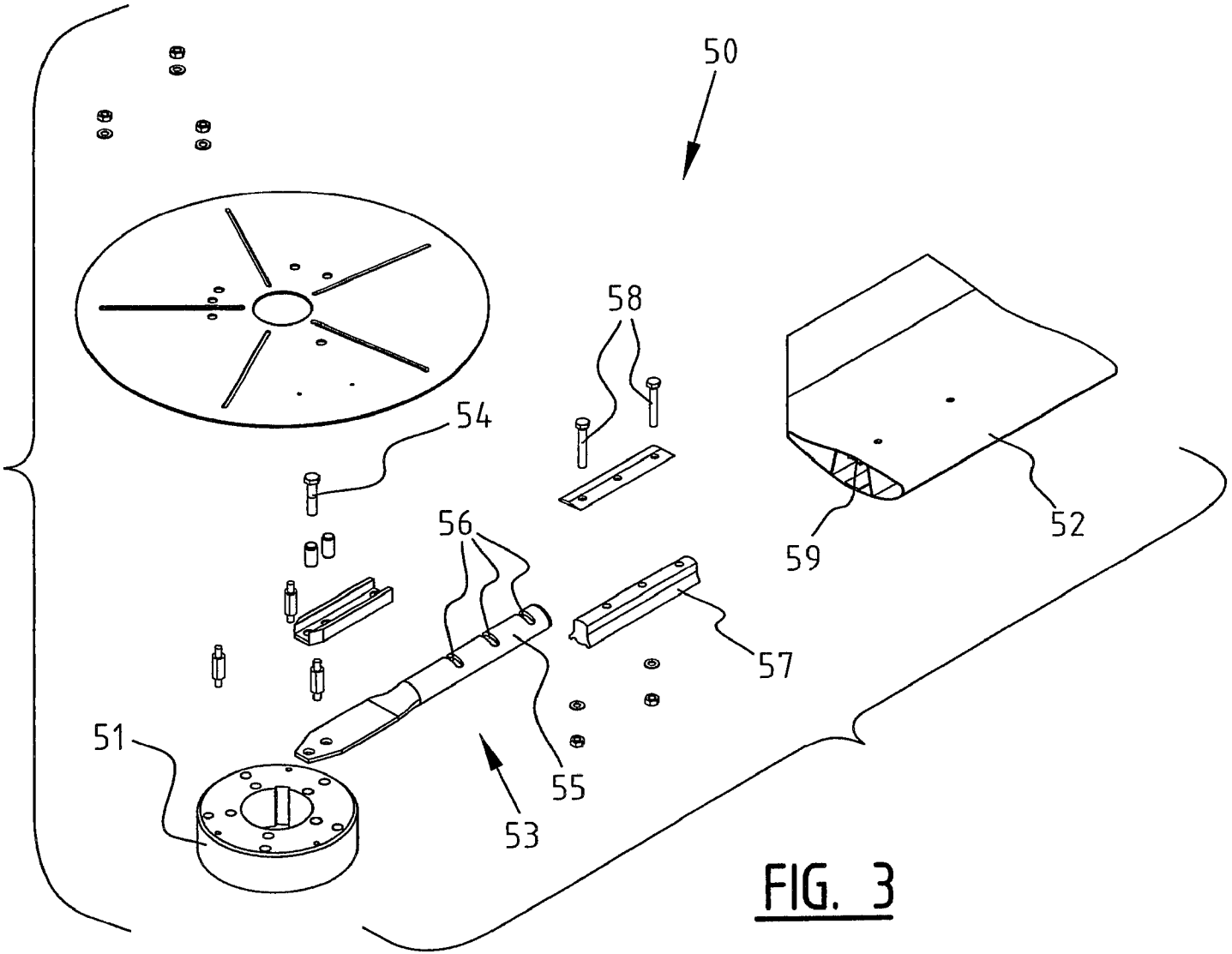
FIG. 3 shows a second embodiment of the axial fan according to the invention.

FIG. 3 shows a second embodiment of a axial fan 50 according to the invention. This axial fan 50 has a hub 51 and blades 52. These blades 52 are arranged to the hub 51 by a strip 53. One end of the flat strip 53 is bolted to the hub 51 by bolts 54. The other end 55 of the strip 53 is concave and provided with slot openings 56. This end 55 is inserted into the hollow blade 52 together with a filler element 57. The end 55 and filler element 57 are mounted in the hollow blade 52 by bolts 58.

The slot openings 56 enables the pitch of the blade 52 to be adjusted. The blade 52 together with the filler element 57 can rotate relative to the strip 53 due to the slot openings 56. In order to assist its rotation, the upper surface of the filler element 57 is partially cylindrical and the inner wall 59 of the cavity in the blade 52 is provided with a concave cylindrical surface.

Figure 4:
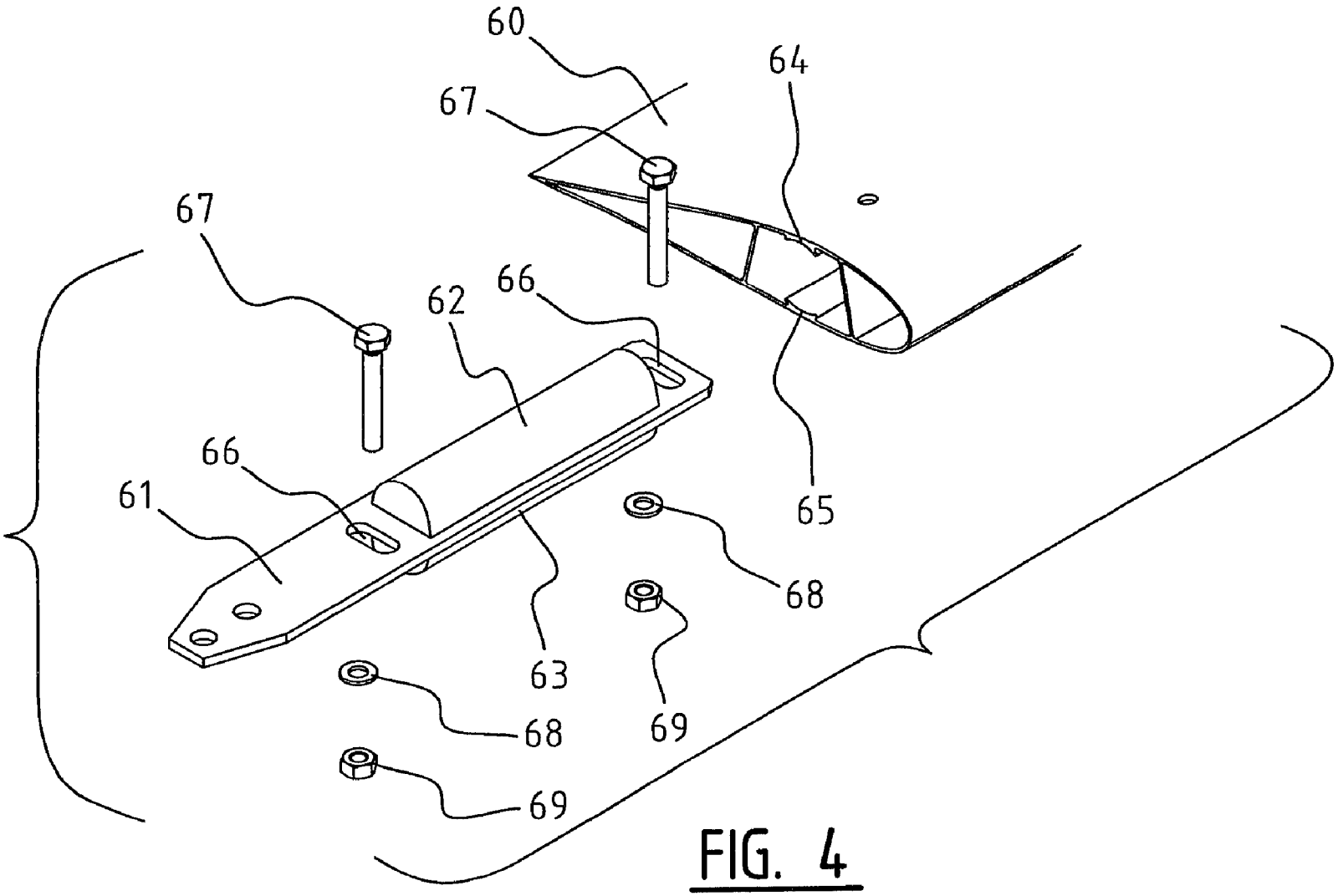
FIG. 4 shows a third embodiment of the axial fan according to the invention.

FIG. 4 shows part of a third embodiment of an axial fan according to the invention. In this embodiment a hollow blade 60 is arranged to a hub (not shown), by a flat strip 61. On either side of the flat strip 61 a semi cylindrical filler part 62, 63 is arranged. This flat strip 61 with the two semi cylindrical filler parts 62, 63 is inserted into the hollow blade 60 such that the filler part 62 is in contact with the inner wall 64 and the filler part 63 is in contact with the concave inner wall 65.

In the strip 61 two slot openings 66 are arranged through which bolts 67 extend and with which the blade is attached to the strip 61. Together with washers 68 and nuts 69 the hollow blade 60 can be attached to the strip 61 in a desired pitch angle.

The invention claimed is:

1. An axial fan comprising a boss and a number of blades evenly distributed and arranged to the boss, wherein the blades have an aerofoil profile, wherein each blade is arranged to the boss with a strip, the strip being attached directly to the boss, wherein each blade is hollow and the strip is at least partially inserted into the blade, wherein at least one fastener runs from the surface of the blade through a corresponding opening in the strip to an opposite surface of the blade, and wherein the corresponding opening in the strip is a slot, such that the pitch of the blade is adjustable by rotation of the blade relative to the strip about the axial axis of the blade.

2. The axial fan according to claim 1, wherein the strip is substantially L-shaped.

3. The axial fan according to claim 2, wherein the boss is substantially cylindrical and a short leg of the L-shaped strip is concave and adapted to the circumferential wall of the boss.

4. The axial fan according to claim 2, wherein for each blade a mounting plate having a mounting surface is provided on the boss and wherein a short leg of the L-shaped strip is mounted on the mounting surface.

5. The axial fan according to claim 1, wherein a filler element is inserted into the hollow blade.

6. The axial fan according to claim 5, wherein the filler element is positioned next to the at least one fastener.

7. The axial fan according to claim 6, wherein the filler element is substantially cylindrical and the end of the strip inserted into the hollow blade is concave.

8. The axial fan according to claim 7, wherein an inner wall of the cavity in which the filler element is inserted, is at least partially adapted to the outer surface of the filler element.

9. The axial fan according to claim 6, wherein the filler element comprises two semi-cylindrical parts arranged on either side of the end of the strip inserted into the hollow blade.

10. The axial fan according to claim 9, wherein an inner wall of the cavity in which the filler element is inserted, is at least partially adapted to the outer surface of the filler element.

11. The axial fan according to claim 6, wherein an inner wall of the cavity in which the filler element is inserted, is at least partially adapted to the outer surface of the filler element.

12. The axial fan according to claim 5, wherein the filler element is substantially cylindrical and the end of the strip inserted into the hollow blade is concave.

13. The axial fan according to claim 12, wherein an inner wall of the cavity in which the filler element is inserted, is at least partially adapted to the outer surface of the filler element.

14. The axial fan according to claim 5, wherein the filler element comprises two semi-cylindrical parts arranged on either side of the end of the strip inserted into the hollow blade.

15. The axial fan according to claim 14 wherein an inner wall of the cavity in which the filler element is inserted, is at least partially adapted to the outer surface of the filler element.

16. The axial fan according to claim 5, wherein an inner wall of the cavity in which the filler element is inserted, is at least partially adapted to the outer surface of the filler element.

17. The axial fan according to claim 1, further comprising a ring shaped housing co-axially arranged to the boss.

* * * * *